US009562322B1

(12) United States Patent
Post

(10) Patent No.: US 9,562,322 B1
(45) Date of Patent: Feb. 7, 2017

(54) FIBROUS MATERIAL REPROCESSING

(71) Applicant: Bouldin Corporation, McMinnville, TN (US)

(72) Inventor: Robert S. Post, McMinnville, TN (US)

(73) Assignee: Bouldin Corporation, McMinnville, TN (US)

( * ) Notice: Subject to any disclaimer, the term of this patent is extended or adjusted under 35 U.S.C. 154(b) by 15 days.

(21) Appl. No.: 14/323,061

(22) Filed: Jul. 3, 2014

(51) Int. Cl.
*D21B 1/02* (2006.01)
*D21B 1/06* (2006.01)

(52) U.S. Cl.
CPC ..... *D21B 1/026* (2013.01); *D21B 1/028* (2013.01); *D21B 1/063* (2013.01)

(58) Field of Classification Search
CPC ..... D21D 1/34; D21D 5/02; D21B 1/026; D21B 1/063; D21B 1/028
USPC ..... 162/4–8
See application file for complete search history.

(56) References Cited

U.S. PATENT DOCUMENTS 4,050,980 A * 9/1977 Schmidt ..... D21C 1/00 162/24
4,219,381 A * 8/1980 Schnell ..... B03B 5/42 162/55
4,376,042 A * 3/1983 Brown ..... D21B 1/023 209/2
5,298,119 A * 3/1994 Brown ..... B07B 1/15 162/55
5,558,281 A 9/1996 Bouldin et al.
5,772,134 A 6/1998 Bouldin et al.
5,918,824 A 7/1999 Bouldin et al.
6,012,663 A 1/2000 Bouldin
6,017,475 A 1/2000 Cantrell
6,837,453 B2 1/2005 Sturm
7,101,164 B2 9/2006 Bouldin
7,168,640 B2 1/2007 Lipowski
7,198,213 B2 4/2007 Kolbet et al.
7,303,160 B2 12/2007 Bouldin et al.
7,311,504 B2 12/2007 Bouldin et al.
7,449,330 B2 11/2008 Bouldin
7,469,850 B2 12/2008 Lipowski et al.
7,503,759 B2 3/2009 Bouldin
7,673,826 B2 3/2010 Kolbet et al.
7,757,983 B2 7/2010 Lipowski et al.
7,757,987 B2 7/2010 Kolbet et al.
7,842,486 B2 11/2010 Bouldin
7,845,620 B1 12/2010 Bouldin
7,883,331 B2 2/2011 Bouldin
8,434,705 B2 5/2013 Lipowski
2002/0184816 A1* 12/2002 Philipson ..... C10L 5/363 44/589

(Continued)

OTHER PUBLICATIONS

Smook, Handbook for Pulp and Paper Technologists, 1992, Angus Wilde Publications, 2nd edition, chapter 16.*

(Continued)

*Primary Examiner* — Anthony Calandra
(74) *Attorney, Agent, or Firm* — Lucian Wayne Beavers; Patterson Intellectual Property Law PC

(57) ABSTRACT

A fibrous material reprocessing apparatus separates a cellulose pulp material into a fibrous material stream and a remainder stream. The fibrous material stream is treated in a grinder to reduce the size of the fibrous material. The reduced size fibrous material is then recombined with the remainder stream.

9 Claims, 6 Drawing Sheets

(56) References Cited

U.S. PATENT DOCUMENTS

| | | | | |
|---|---|---|---|---|
| 2005/0067123 | A1* | 3/2005 | DeZutter | D21B 1/061 162/52 |
| 2005/0121371 | A1* | 6/2005 | Hautala | D21B 1/32 209/270 |
| 2011/0062263 | A1* | 3/2011 | Bartelt | B02C 18/142 241/236 |
| 2014/0008474 | A1 | 1/2014 | Bouldin et al. | |

OTHER PUBLICATIONS

Website printout of "Plastic Granulators by Foremost Machine Builders" is provided from www.foremostmachine.com/granulators (2 pages) (admitted to be dated prior to Jul. 3, 2014).

* cited by examiner

Raw Material From Star Screener

Granulated Using Screen with 3/16" Diameter Perforations

Control Group Before Granulator

Subject Group After Granulator

*textile length comparison*

*textile length distribution*

*bulk sample comparison*

FIBROUS MATERIAL REPROCESSING

BACKGROUND OF THE INVENTION

1. Field of the Invention

The present invention relates to methods and apparatus for the processing of a cellulose pulp mixture as part of a process of treating and reusing waste material such as municipal garbage.

2. Description of the Prior Art

The assignee of the present invention has previously developed methods and apparatus for treating municipal waste materials to produce a cellulose pulp mixture which may then be used for various purposes including pelletizing of the cellulose pulp mixture, burning the cellulose pulp mixture to recover energy therefrom, use of the cellulose pulp mixture as a soil amendment, formation of the cellulose pulp mixture into rigid extruded articles, and other uses. The cellulose pulp mixture is created by hydrolyzing a waste mixture which has previously been shredded and had some undesirable material such as metals removed therefrom. The hydrolyzing technique involves applying heat and pressure to the waste mixture in the presence of water to convert the waste mixture into the cellulose pulp mixture. Examples of that process are found in U.S. Pat. No. 7,883,331; U.S. Pat. No. 6,017,475; and U.S. Patent Application Publication 2014/0008474.

SUMMARY OF THE INVENTION

The present invention relates to improved methods and apparatus for treating the cellulose pulp mixture post hydrolization.

In one embodiment, a method of processing a waste mixture comprises the steps of:

(a) hydrolyzing the waste mixture to create a cellulose pulp mixture including fibrous material and non-fibrous material;

(b) separating the cellulose pulp mixture into first and second streams, the first stream including at least a coarser portion of the fibrous material of larger size than fibrous material that may remain in the second stream;

(c) mechanically reducing an average size of the coarser portion of fibrous material to form finer fibrous material; and (d) recombining the finer fibrous material with the second stream to form a refined cellulose pulp mixture.

In another embodiment a waste fibrous material processing apparatus includes a mechanical separator including an inlet for receiving a mixture including fibrous material and non-fibrous material, a coarse portion outlet for a fibrous material stream including at least a coarser portion of the fibrous materials, and a remainder outlet for a remainder stream of remaining material from the mixture. A mechanical grinder includes an inlet for receiving the fibrous material stream including the coarser portion of the fibrous material. The mechanical grinder includes an outlet for discharging a finer fibrous material stream. A recombining zone is provided. A remainder conveyor is arranged to transport the remainder stream to the recombining zone. A return conveyor is arranged to transport the finer fibrous material stream to the recombining zone, so that the finer fibrous material stream is recombined with the remainder stream.

In any of the above embodiments the mechanical separator may be a star screener.

In any of the above embodiments the mechanical reducer or grinder may be a granulator. The granulator may be a straight blade granulator.

In any of the above embodiments the granulator may have a throughput of at least 400 lbs/hour and have a drive motor of no greater than 30 HP.

In any of the above embodiments a dryer may be located downstream of the recombining zones so that the refined cellulose pulp mixture from the recombining zone is dried.

In any of the above embodiments the dryer may be a continuous process mechanical dryer, preferably a belt dryer.

In any of the above embodiments, subsequent to drying the refined cellulose pulp mixture the dried refined cellulose pulp mixture may be used in many ways including pelletizing the same in a pelletizer located downstream of the dryer, for subsequent use.

In any of the above embodiments the coarser portion of fibrous material removed from the cellulose pulp mixture in the mechanical separator may include pieces of fibrous material having lengths in excess of 3.0 inches.

Numerous objects, features and advantages of the present invention will be readily apparent to those skilled in the art upon a reading of the following disclosure when taken in conjunction with the accompanying drawings.

DETAILED DESCRIPTION

Figure 1:
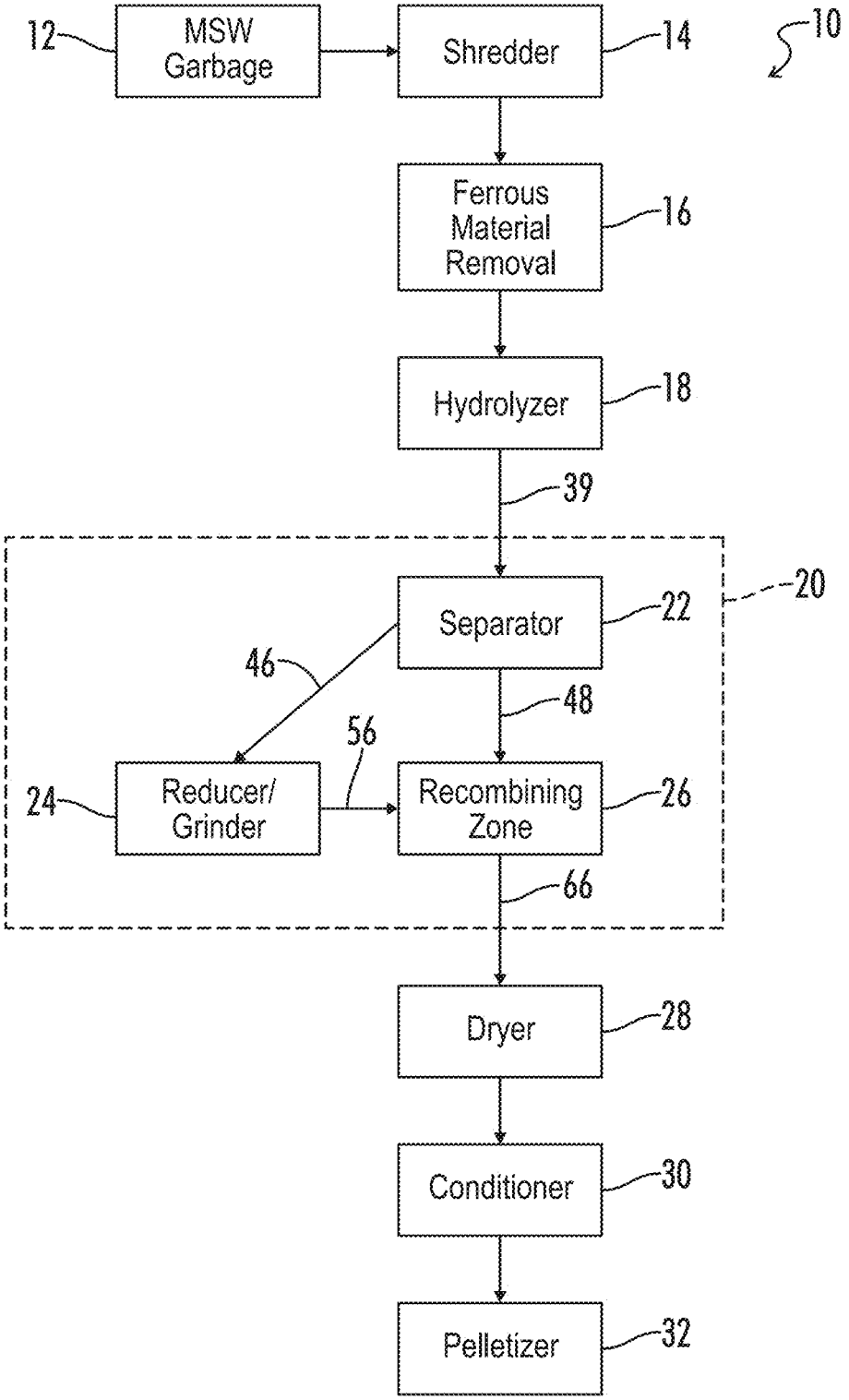
FIG. 1 is a schematic illustration of a process line for converting municipal solid waste into a cellulose pulp mixture and the conversion of that cellulose pulp mixture into a useful article such as pelletized material.

Referring now to FIG. 1, a schematic illustration is thereshown of a municipal waste processing system 10. In the system 10, municipal solid waste or garbage as indicated at 12 may first go through one or more shredders 14, followed by removal of extraneous material such as in a ferrous metal removal station 16.

The material is then introduced to a hydrolyzer 18 where it is treated under pressure and temperature in the presence of water. The hydrolyzer 18 may for example be constructed in accordance with any one of the following U.S. patents, which are assigned to the assignee of the present invention and which are incorporated herein by reference: U.S. Pat. No. 7,883,331; U.S. Pat. No. 6,017,475; and U.S. Patent Application Publication 2014/0008474.

The material produced by the hydrolyzer is a cellulose pulp mixture which includes fibrous material and non-fibrous material. The fibrous material is also often referred to as textile material because much of the fibrous material is derived from woven textiles. Such a cellulose pulp mixture is presently marketed by the assignee of the present invention under the trademark FLUFF®.

Downstream of the hydrolyzer 18, as schematically illustrated within the dashed rectangle in FIG. 1, is a separating, reducing and recombining apparatus 20 which includes a mechanical separator 22, a mechanical reducer or grinder 24, and a recombining zone 26. Downstream of the recombining zone 26 of the separating, reducing and recombining apparatus 20 is a dryer 28 followed by various conditioning apparatus 30 and a pelletizing apparatus 32.

The dryer 28 is preferably a mechanical dryer and preferably a mechanical belt-type dryer.

The conditioner 30 is a piece of equipment with a cylindrical housing arranged with the axis horizontally, supporting a rotating shaft inside. The shaft supports, and is connected to, a helical shaped auger in the inlet end, changing to adjustable paddle shaped tines near the midpoint of the shaft. Adjustable tines are connected, to and supported by, the shaft from the midpoint to the exit of the conditioner. Conditioners are used to blend raw materials such as wood chips or cellulose pulp mixture, with chemical additives prior to pelletizing in the pelletizer 32. Raw material enters the conditioner 30 through an opening at the top of the housing at one end. The rotating helical auger advances the raw material toward the center of the conditioner housing. Liquid additives can be injected near the midpoint of the housing allowing the tines to blend the raw material with the additives. The tines are arranged in a helical pattern, propelling the mixture toward the exit end of the conditioner. The mixture then exits the conditioner through an opening at the bottom of the chamber, allowing the blended mixture to enter the pellet mill 32.

Figure 2:
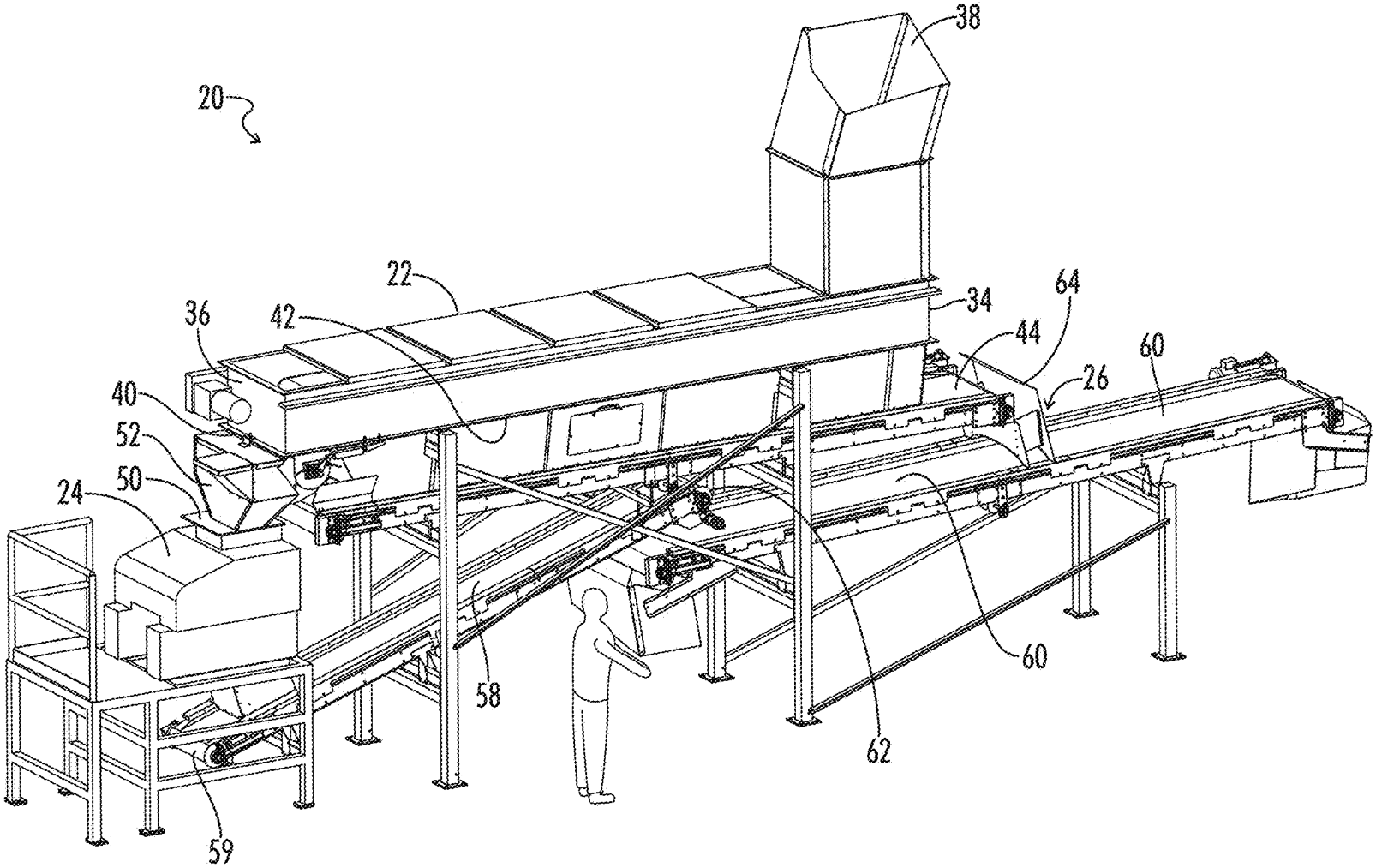
FIG. 2 is a schematic perspective view of a processing apparatus including a mechanical separator, a mechanical grinder, and appropriate conveyors for recombining the material from the grinder with the remaining output from the separator.
Figure 3:
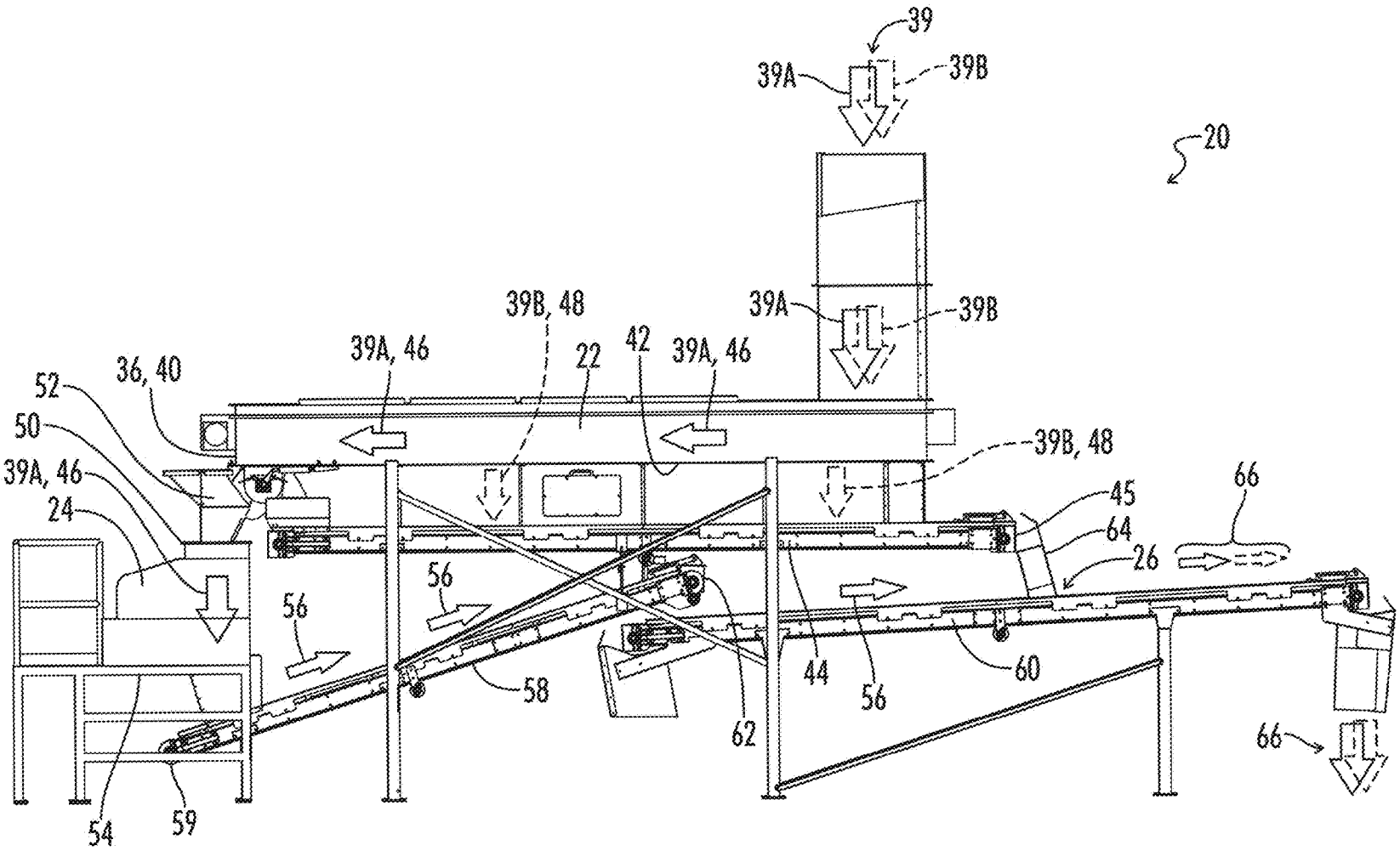
FIG. 3 is an elevation schematic view of the apparatus of FIG. 2 including flow indicator arrows to show the flow of various components through the system.

Referring now to FIGS. 2 and 3, more detailed views are shown of the separating, reducing and recombining apparatus 20. The apparatus 20 may be more generally referred to as a waste fibrous material processing apparatus 20. As noted, the apparatus 20 includes the mechanical separator 22, and the mechanical reducer or grinder 24.

The mechanical separator 22 may for example be a star screener that conveys larger material laterally from an inlet end 34 toward an outlet end 36 along the upper surface of a plurality of parallel rows of rotating star shaped wheels which allow the larger or coarser pieces of material to remain above the rows of star shaped wheels, and allow the finer smaller bits of material to drop between the star shaped wheels. Such star screeners may for example be obtained from Continental Biomass Industries under the model name Stationary Star Screener.

The mechanical separator 22 includes an inlet 38 for receiving the cellulose pulp mixture from the hydrolyzer 18. Separator 22 includes a coarse portion outlet 40 which will eject a fibrous material stream including at least a coarser portion of the fibrous materials contained in the cellulose pulp mixture received at the inlet 38.

As best seen in FIG. 3, the separator 22 includes a remainder outlet 42 which may extend across the entire lower side of separator 22 so that the finer materials contained in the incoming cellulose pulp mixture may drop through the remainder outlet 42 onto a remainder conveyor belt 44.

In FIG. 3, an incoming stream 39 of cellulose pulp mixture is schematically illustrated as including a fibrous material component 39A and a remainder 39B, with the fibrous material component being represented by a hollow arrow in solid lines, and with the remainder component being represented by a hollow arrow formed of dashed lines.

As indicated by the hollow solid line arrows 39A in FIG. 3, a first stream 46 including at least a coarser portion of the fibrous materials of larger size than any fibrous materials remaining in the remainder stream flows from right to left across the star screen separator 22 out the outlet 40 thereof and drops into the mechanical reducer or grinder 24. It is noted that this first stream 46 will also still include some of the non-fibrous material 39B, which may for example be bits of plastic, rubber, and various fine particles of debris.

A second stream or remainder stream 48 exits through the remainder outlet 42 and is collected on and carried away by the remainder conveyor belt 44. Most of the non-fibrous material 39B will be in this remainder stream 48.

The mechanical grinder 24 includes an inlet 50 for receiving the fibrous material stream 46 from the coarse portion outlet 40 of separator 22. A chute 52 may be provided to convey the first stream 46 from the outlet 40 of separator 22 to the inlet 50 of mechanical grinder 24.

The mechanical grinder 24 includes an outlet 54 for discharging a finer fibrous material stream 56 indicated by the narrower solid line arrows 56 in FIG. 3. The finer fibrous material stream 56 drops onto a return conveyor 58.

A recombining conveyor 60 is provided which includes the recombining zone 26 defined thereon. Each of the remainder conveyor 44 and the return conveyor 58 discharge onto the recombining conveyor 60. In the embodiment illustrated, a discharge end 62 of return conveyor 58 is located above a left end of the recombining conveyor 60 so that initially the finer fibrous material stream 56 is continuing along the recombining conveyor 60 until it reaches the recombining zone 26 below the right hand end of remainder conveyor 44 where a guide plate 64 guides the remainder stream 48 onto the recombining conveyor 60 where it recombines with the finer fibrous material stream 56 to form a refined cellulose pulp mixture stream 66 schematically illustrated in FIG. 3.

The remainder conveyor 44, return conveyor 58, and recombining conveyor 60 may all be belt type conveyors. Alternatively, any other suitable conveyor may be used, such as augers, blowers and the like.

In the arrangement shown in FIG. 3, the inlet 50 of the mechanical grinder 24 is located below the coarse portion outlet 40 of the mechanical separator 22. The remainder conveyor 44 is located below the remainder outlet 42 of the mechanical separator 22 and conveys the remainder stream 48 in a direction away from the coarse portion outlet 40 to a discharge end 45 located above the recombining conveyor 60. The return conveyor 58 has a receiving end 59 located below the outlet 54 of the mechanical grinder 24, and a discharge end 62 located above the recombining conveyor 60.

The mechanical grinder 24 may for example be the type of grinder referred to as a granulator, and more preferably may be a straight blade granulator. Suitable granulators for use with the present invention may for example be obtained from Foremost Machine Builders, Inc. of Fairfield, N.J. such as their model HD-5B.

By separating the coarser fibrous material out of the cellulose pulp mixture and separately treating the coarser fibrous material to reduce the size of the same, and then recombining that reduced size material with the remainder portion of the cellulose pulp material, a reduction in size of the pieces of material contained in the cellulose pulp mixture may be efficiently achieved. The granulator 24 is not required to grind material which does not need to be reduced in size. Furthermore, many of the smaller particles which are separated out in the separator 22 are hard, brittle and abrasive and would accelerate wear on the granulator 24. For example, the granulator 24 may be designed to have a throughput of at least 400 lbs/hour utilizing a drive motor of no greater than 30 HP.

Methods of Processing Waste Mixtures

The methods of processing a waste mixture utilizing the apparatus of FIGS. 2 and 3 may be generally described as follows. As indicated in FIGS. 1 and 3, the hydrolyzer 18 may hydrolyze the waste mixture to create a cellulose pulp mixture 39 including fibrous materials 39A and non-fibrous materials 39B.

Then, in the mechanical separator 22, the cellulose pulp mixture may be separated into a first stream 46 and a second stream 48. The first stream 46 includes at least a coarser portion of the fibrous materials of larger size than fibrous materials which may remain in the second stream 48. The first stream 46 will also include some of the non-fibrous material 39B which is entrained with the fibrous materials in the first stream 46. The second stream 48 will include most of the non-fibrous materials 39B.

Then, in the mechanical grinder 24, an average size of the coarser portion of fibrous material is reduced to form a finer fibrous material 56.

Then using the return conveyor 58, the remainder conveyor 44, and the recombining conveyor 60, the finer fibrous material 56 is recombined with the second stream 48 to form a refined cellulose pulp mixture 66.

Figure 4:
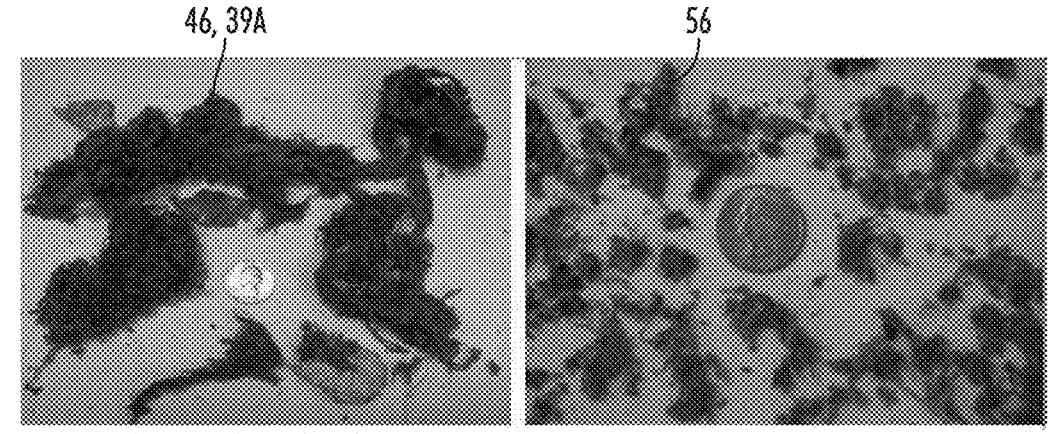
FIG. 4 includes side-by-side photographs of a coarser fibrous material on the left such as enters the mechanical grinder, and a finer fibrous material on the right such as exits the mechanical grinder. It is noted that in these photographs there is still a substantial amount of non-fibrous or non-textile material in the stream of material. These materials are shown adjacent a U.S. quarter to provide the appropriate scale to the illustrations.

FIG. 4 includes a side-by-side comparison of photographs of the first stream 46 of coarser fibrous material collected from the exit 40 of the separator 22 on the left, and the finer fibrous material stream 56 exiting the outlet 54 of the mechanical grinder 24 on the right. For the example shown, the mechanical grinder 24 was a Foremost HD-5B granulator utilizing a screen with 3/16 inch diameter perforations. As is apparent in viewing the photographs on the left and right side of FIG. 4, the coarser portion of fibrous material in the first stream 46 includes pieces of fibrous material in large clumps. These clumps may include multiple strings of fibrous material with other fine materials entrained therein. The clumps have dimensions of several inches in length and an inch or more in width. By comparison, the finer fibrous material 56 illustrated on the right hand side of FIG. 4, which also includes much fine non-fibrous material which has fallen away from the large clumps, has an average piece size of less than 1.0 inch.

The reduction in length of the fibrous materials is particularly advantageous for any post hydrolyzing conditioning of the cellulose pulp mixture which involves rotating components which may otherwise become entangled with long fibrous pieces of material, such as for example the conditioner 30.

In an attempt to further quantify the reduction in length and size of the individual strings of fibrous material in the stream of material flowing through the mechanical grinder 24, a further study was done as illustrated in FIGS. 5-9.

Figure 5:
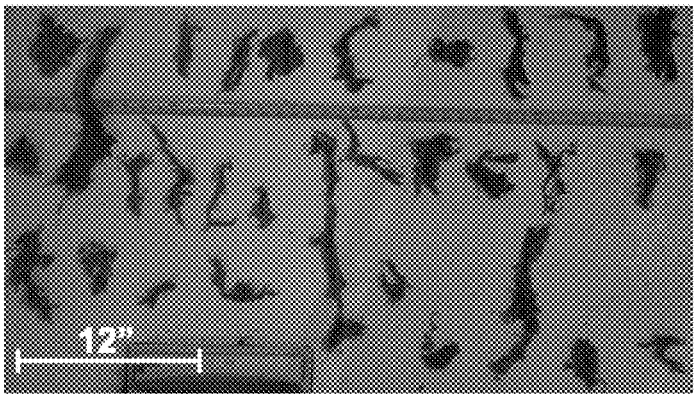
FIG. 5 is a photograph of a control group of 30 randomly selected pieces of coarser fibrous material before entering the mechanical grinder, selected from the material stream like shown on the left side of FIG. 4. These pieces are displayed adjacent a ruler graded in inches.
Figure 6:
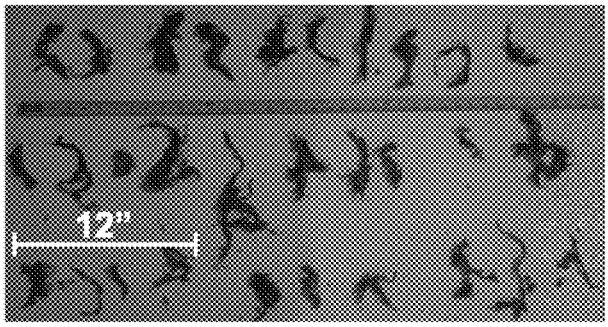
FIG. 6 is a photograph of 30 randomly selected pieces of finer fibrous material after having been processed in the mechanical grinder, selected from the material stream like shown on the right hand side of FIG. 4.

In order to study the length of individual strings of fibrous material it was necessary to separate those strings from the clumps seen in the left side of FIG. 4, and from the other debris present in the right side of FIG. 4. This was done and a random sample of 30 pieces of string-like, i.e. fibrous, material were selected from the input and output streams represented by the left and right sides of FIG. 4, respectively. Those 30 pieces for each of the input and output streams from the mechanical grinder 24 are shown in the photographs of FIGS. 5 and 6, respectively.

Each of those pieces of material was then measured. The raw measurements for the 30 incoming pieces and the 30 outgoing pieces of fibrous material are set forth in the following Table:

Raw Data Table-Textile length measurements

| | | | | Histogram | | |
|---|---|---|---|---|---|---|
| | BEFORE | AFTER | | bins | BEFORE | AFTER |
| 1 | 4.5 | 2.5 | | | | |
| 2 | 11.7 | 4 | | | | |
| 3 | 4.5 | 2.5 | | | | |
| 4 | 5 | 5 | | | | |
| 5 | 3.7 | 4 | | | | |
| 6 | 6.5 | 3 | | | | |
| 7 | 3.7 | 4 | | | | |
| 8 | 5 | 4 | | 0 | 0 | 0 |
| 9 | 3 | 8 | | 1 | 0 | 0 |
| 10 | 2.5 | 4 | | 2 | 1 | 1 |
| 11 | 4.5 | 3 | | 3 | 4 | 5 |
| 12 | 8.5 | 7 | | 4 | 7 | 8 |
| 13 | 6 | 2 | | 5 | 7 | 9 |
| 14 | 6 | 6.5 | | 6 | 4 | 2 |
| 15 | 3 | 9 | | 7 | 2 | 3 |
| 16 | 14.5 | 4.5 | | 8 | 0 | 1 |
| 17 | 5.5 | 5 | | 9 | 2 | 1 |
| 18 | 3.5 | 3.7 | | 10 | 0 | 0 |
| 19 | 2 | 3 | | 11 | 1 | 0 |
| 20 | 5 | 6.5 | | 12 | 1 | 0 |
| 21 | 6 | 5 | | 13 | 0 | 0 |
| 22 | 11 | 3.5 | | 14 | 0 | 0 |
| 23 | 4 | 5 | | 15 | 1 | 0 |
| 24 | 3 | 5 | | | | |
| 25 | 5 | 4 | | | | |
| 26 | 7 | 5 | | | | |
| 27 | 9 | 6 | | | | |
| 28 | 4 | 5 | | | | |
| 29 | 4 | 6 | | | | |
| 30 | 3.5 | 4.5 | | | | |
| median | 4.8 | 4.5 | | | | |
| std dev | 2.9 | 1.6 | | | | |
| mean | 4.9 | 4.4 | | | | |
| Kurtosis | 2.6 | 0.7 | | | | |
| | 76.7 | 34.3 | grams | | | |

Figure 7:
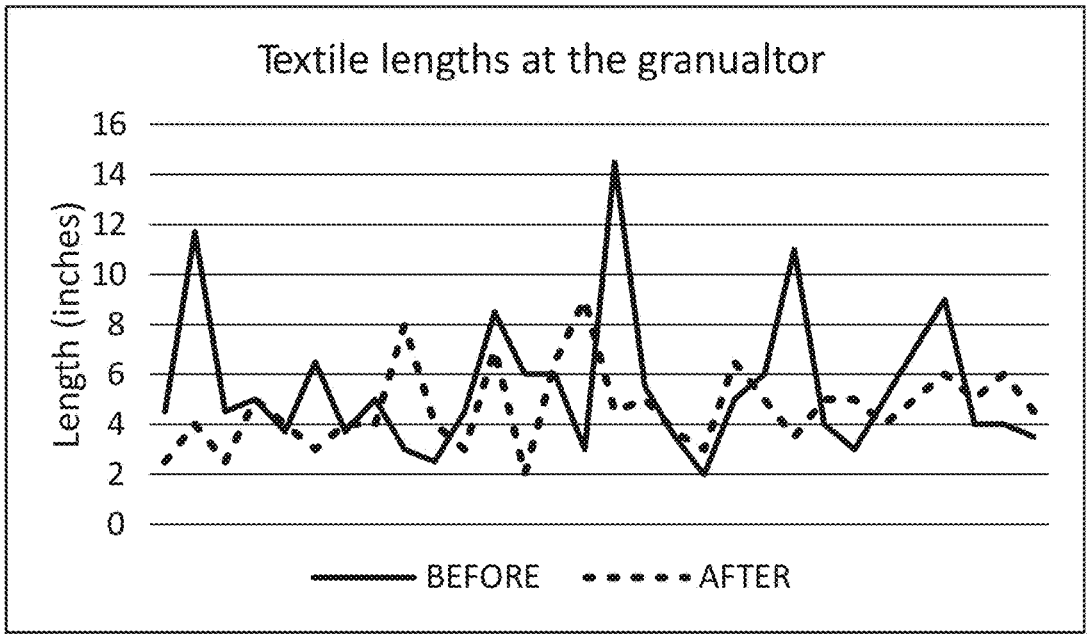
FIG. 7 is a graphical display of before and after textile lengths in inches for the samples of FIGS. 5 and 6.
Figure 8:
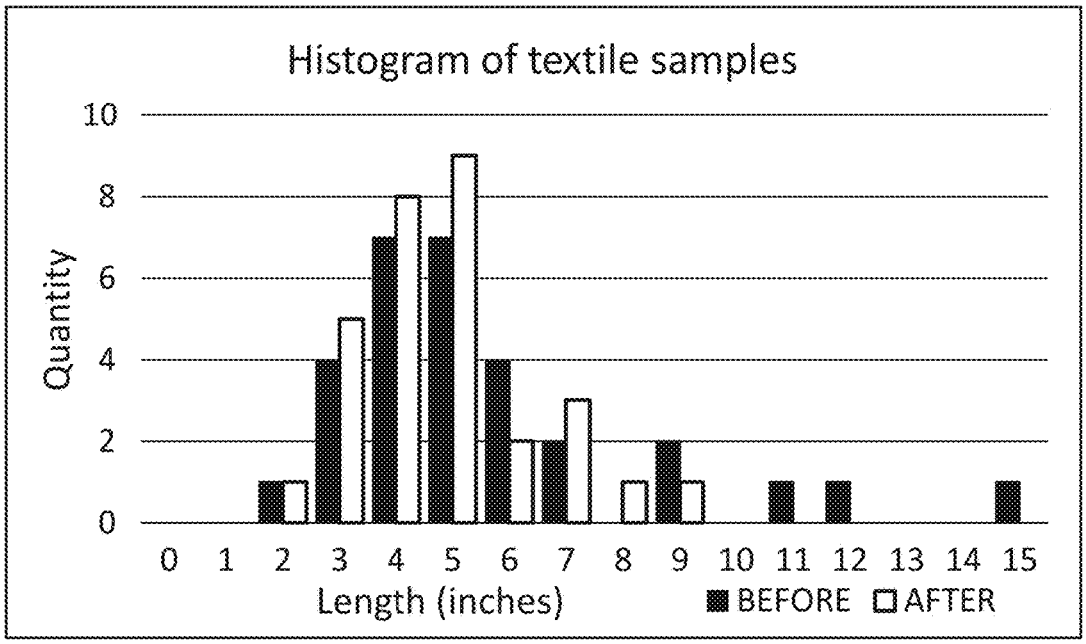
FIG. 8 is a histogram of before and after textile lengths in inches for the samples of FIGS. 5 and 6.

FIGS. 7 and 8 graphically illustrate the data from the table. In FIG. 7 each of the values of length of the "before" data from the table are plotted against item number, and the solid line then joins those points. The dotted line joins the plotted points for the sequence of "after" data from the table. In FIG. 8 the data is presented in the form of a histogram showing the quantity of pieces (of the 30 pieces) that fell within various length ranges.

Figure 9:
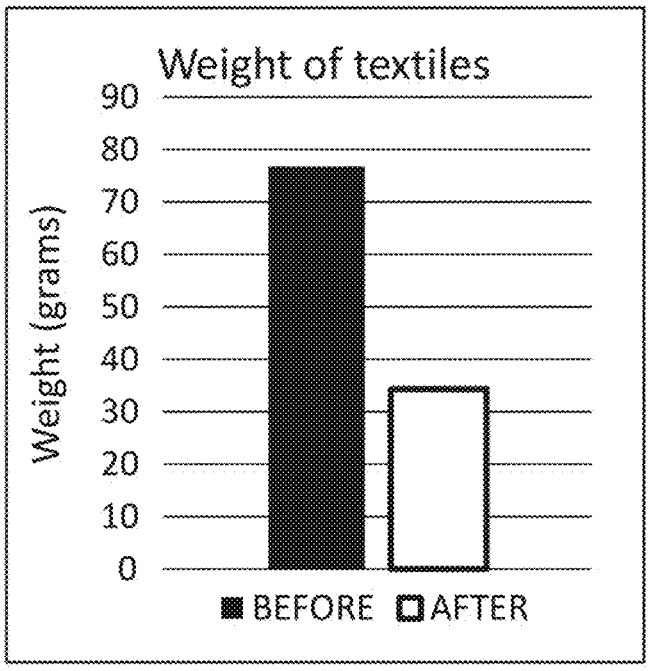
FIG. 9 is a graphical comparison of before and after bulk sample weight for the samples of FIGS. 5 and 6.

In FIG. 9, the weight of the bulk sample of 30 "before" pieces is compared to the weight of the bulk sample of 30 "after" pieces.

In general the fibrous material exiting the mechanical grinder 24 is seen to be shorter, more consistent in length, and has lower volume when compared by weight. A statistical analysis of the data from the table shows that, compared to the incoming control group pieces shown in FIG. 5, the pieces of fibrous material exiting the mechanical grinder 24 as shown in FIG. 6 have:

1. Reduced median length (5%);
2. Reduced weight (45%);
3. Reduced length standard deviation (56%); and
4. Reduced length Kurtosis (26%).

This general reduction in length, weight and overall size of the fibrous material is of particular advantage later in the process when the refined cellulose material stream 66 flows through the subsequent equipment such as conditioner 30 and pelletizer 32 seen in FIG. 1. Because of the rotating components of that equipment, the shorter fibrous material causes much less problem of collecting on the rotating components and clogging the equipment.

Thus, although there have been described particular embodiments of the present invention of a new and useful Fibrous Material Reprocessing system it is not intended that such references be construed as limitations upon the scope of this invention except as set forth in the following claims.

What is claimed is:

1. A waste fibrous material processing apparatus comprising:

a horizontally extending elongate mechanical separator including:

an inlet end including a separator inlet;

a course portion outlet end including a coarse portion outlet; and a remainder outlet extending along a bottom of the elongate mechanical separator;

a mechanical grinder including a grinder outlet and a grinder inlet, the grinder inlet configured to receive material from the coarse portion outlet of the elongate mechanical separator by gravity;

a remainder conveyor belt located below the elongate mechanical separator along the remainder outlet, the remainder conveyor belt including a remainder conveyor output end;

a return conveyor belt located below the grinder outlet, the return conveyor belt including a return conveyor output end; and a recombining conveyor belt configured to receive material from the remainder conveyor output end and the return conveyor output end by gravity.

2. The apparatus of claim 1, wherein the remainder outlet extends across the entire bottom of the elongate mechanical separator.

3. The apparatus of claim 1, wherein:

the elongate mechanical separator conveys material in a first direction; and the remainder conveyor belt conveys material in a second direction opposite the first direction.

4. The apparatus of claim 3, wherein the return conveyor belt conveys material in the second direction.

5. The apparatus of claim 4, wherein the recombining conveyor belt conveys material in the second direction.

6. The apparatus of claim 1, wherein the mechanical grinder further includes a chute mounted thereto to direct the material from the coarse portion outlet of the elongate mechanical separator to the grinder inlet.

7. The apparatus of claim 1, wherein the remainder outlet comprises a plurality of openings in the bottom of the elongate mechanical separator.

8. The apparatus of claim 1, further comprising a hydrolyzer upstream of the separator inlet.

9. The apparatus of claim 8, further comprising a dryer downstream of the recombining conveyor belt.

* * * * *